US007124794B2

(12) United States Patent
Marx

(10) Patent No.: US 7,124,794 B2
(45) Date of Patent: Oct. 24, 2006

(54) BI-DIRECTIONAL EQUAL FORCE LOG SPLITTER

(76) Inventor: Daniel A. Marx, 917 Ottawa, Royal Oak, MI (US) 48073

( * ) Notice: Subject to any disclaimer, the term of this patent is extended or adjusted under 35 U.S.C. 154(b) by 88 days.

(21) Appl. No.: 10/646,106

(22) Filed: Aug. 21, 2003

(65) Prior Publication Data

US 2004/0250895 A1 Dec. 16, 2004

Related U.S. Application Data

(60) Provisional application No. 60/405,042, filed on Aug. 21, 2002.

(51) Int. Cl.
*B27L 7/06* (2006.01)
*B27L 7/00* (2006.01)

(52) U.S. Cl. ..... 144/193.2; 144/195.1; 144/195.8

(58) Field of Classification Search ..... 144/193.1, 144/193.2, 194, 195.6, 195.8, 195.1, 195.7
See application file for complete search history.

(56) References Cited

U.S. PATENT DOCUMENTS 3,319,675 A 5/1967 Bles, Sr.
3,974,867 A 8/1976 Butas, Jr.
4,209,046 A * 6/1980 Lavigne ..... 144/195.7
4,239,070 A * 12/1980 Burns ..... 144/195.1
4,310,039 A * 1/1982 O'Brien ..... 144/195.1
4,351,377 A 9/1982 Hamel
4,416,313 A 11/1983 Seeger
4,423,759 A 1/1984 Seeger
4,655,269 A 4/1987 Hanser et al.
4,679,607 A * 7/1987 Bradley ..... 144/195.1
4,945,960 A 8/1990 McCauley
5,284,193 A 2/1994 Mires et al.
5,651,404 A 7/1997 Kraemer et al.
5,711,357 A 1/1998 Smith
5,921,300 A 7/1999 Smith
5,957,175 A 9/1999 Smith
6,135,178 A 10/2000 Fager
6,318,929 B1 * 11/2001 Basta ..... 405/3

* cited by examiner

*Primary Examiner*—Lowell A. Larson
*Assistant Examiner*—Shelley Self
(74) *Attorney, Agent, or Firm*—Gifford, Krass, Groh, Sprinkle, Anderson & Citkowski, P.C.

(57) ABSTRACT

A bi-directional log splitter having at least two stationary splitting wedges and a moveable ram therebetween for splitting wood, said splitter being mounted on a trailer where the splitter exerts a substantially equal force for both the exertion and the retraction strokes to increase the production of split wood.

18 Claims, 5 Drawing Sheets

BI-DIRECTIONAL EQUAL FORCE LOG SPLITTER

CROSS REFERENCES TO RELATED APPLICATIONS

This application claims the benefit of U.S. Provisional Application No. 60/405,042 filed on Aug. 21, 2002.

TECHNICAL FIELD

This invention relates generally to log splitters, and more particularly to a bi-directional log splitter which can split logs in both directions with equal force.

BACKGROUND OF THE INVENTION

Log splitting has been going on as long as man has been burning wood for fire. Until recently, logs were either split by hand using an ax, or using a pneumatic or hydraulic log splitter. The earliest log splitters were single direction log splitters, where a log was placed near a wedge and a ram pushed the log against the wedge, thereby splitting the log. However, these log-splitting devices were slow, and were not amenable to production methods and quantities required because each log required a single stroke of the ram, and the ram needed to be returned to the original position. In the spirit of increasing production, in the recent history, bi-directional wood splitting devices were invented in order to speed up the log splitting procedure.

In the past, certain attempts were made to make a log-splitting device which included two splitting wedges with a hydraulic ram therebetween in order to utilize each stroke of the ram to split logs, in both directions. These bi-directional log-splitting devices did not meet with much success, because the forces of the hydraulic ram were greater in one direction than in the other. For instance, most of the devices known to the inventor have a capacity of nearly 20,000 pounds of force in one direction, while only 8,000 pounds of force may be exerted on the return stroke. This meant that the operator of the log-splitting device needed to carefully select the logs that he would be splitting in order to match the logs with the force being exerted in either direction. Needless to say, this is cumbersome and unwieldy.

Such an attempt was made by Joseph T. Butas, Jr., in the disclosure in his U.S. Pat. No. 3,974,867 issued Aug. 17, 1996, in which a log splitter for use in a high production environment utilizes a four-way, step knife blade at either end of a longitudinal stroke. Although this invention utilizes a self-centering circular ram connected to a two-way hydraulic cylinder, it is apparent that unequal forces are experienced between the extension and the return of the hydraulic stroke.

U.S. Pat. No. 4,351,377 issued Sep. 28, 1982, to Daniel L. Hamel discloses a bi-directional log splitter, although it uses a double-faced log-splitting wedge secured to the rail generally mid-way of the stroke motion of the log transporting bed. The log-splitting wedge is arranged to engage and split logs traveling within the bed.

U.S. Pat. No. 4,416,313 issued Nov. 22, 1983, to Richard E. Seeger discloses a double acting log splitter utilizing a carriage which is driven in opposite directions by an operating mechanism which includes a nut carried by the carriage for movement and a screw having one end fixed axially by and rotatably supported in bearings located at one end of the frame. A reversible drive motor is connected to the supported end of the screw for rotatably driving the screw in one direction or in its reverse. U.S. Pat. No. 4,423,759 issued Jan. 3, 1984, also issued to Richard E. Seeger, discloses an electrically powered log splitter, again with a reversible electric motor.

Lastly, U.S. Pat. No. 4,945,960 issued Aug. 7, 1990, to Christopher J. McCauley discloses a double action vertical wood splitter, with a removable double edged blade mounted on a elongated carriage which telescopically interacts with the frame resulting in a log splitter which can be used in either direction.

Therefore, it would be advantageous for an equal force bi-directional log splitter to be provided to increase the yield and production of the log splitting operation. It would also be an advantage to have this log splitter be small, convenient, and trailerable. It would be of special advantage if the cylinders were arranged to exert an equal lateral force, providing the same degree of compressibility in both directions.

It would furthermore be an advantage to utilize a double direction log splitter to increase production of split logs while exhibiting a minimal leverage effect on the log splitter itself. Further, it would be an even bigger advantage to include the use of a four-way knifed wedge with a double action equal force log splitter, whereby each log would be split into four pieces once the four-way star-shaped splitting head was compressed through a log.

SUMMARY OF THE INVENTION

In accordance with the above advantages and objects, the present invention discloses a bi-directional log-splitting device exhibiting equal lateral forces in both directions in order to increase production in log splitting operations. A pair of hydraulic cylinders is utilized on the log-splitting device to provide equal forces in either direction with the same degree of compressibility when the logs are split. In order to further increase production, a four-way star-shaped splitting head may also be utilized on both ends of the log splitter, so that each log may be split into four pieces, thereby further increasing production. The use of two double-acting cylinders means that the log splitter is able to push and pull the ram at the same time, thereby adding to the degree of compressibility, and increasing the certainty of the log splitting effect itself. The configuration of the log splitter and its commensurate guide rods yield a log-splitting device with a minimal leverage effect, unlike those in the prior art. This feature will furthermore increase the productivity of the log-splitting device, and it is described more fully hereinbelow.

The present invention, through the use of its two double-acting cylinders, is able to exhibit an equal lateral force, on the order of about up to 30,000 pounds (15 tons) in each direction. This is unlike the prior art where the forces are uneven, i.e. where the extension force is much greater than the retraction force.

Therefore, the present invention meets and/or exceeds the above objects and advantages, and discloses a novel and non-obvious invention over the prior art. The invention is best understood by reading the Detailed Description in conjunction with the appendant drawings, briefly described below.

BRIEF DESCRIPTION OF THE DRAWINGS

For a further understanding of the nature and advantages of the expected scope and various embodiments of the present invention, reference shall be made to the following detailed description, and when taken in conjunction with the accompanying drawings, in which like parts are given the same reference numerals, and wherein.

DETAILED DESCRIPTION OF THE INVENTION

Figures 1, 1A:
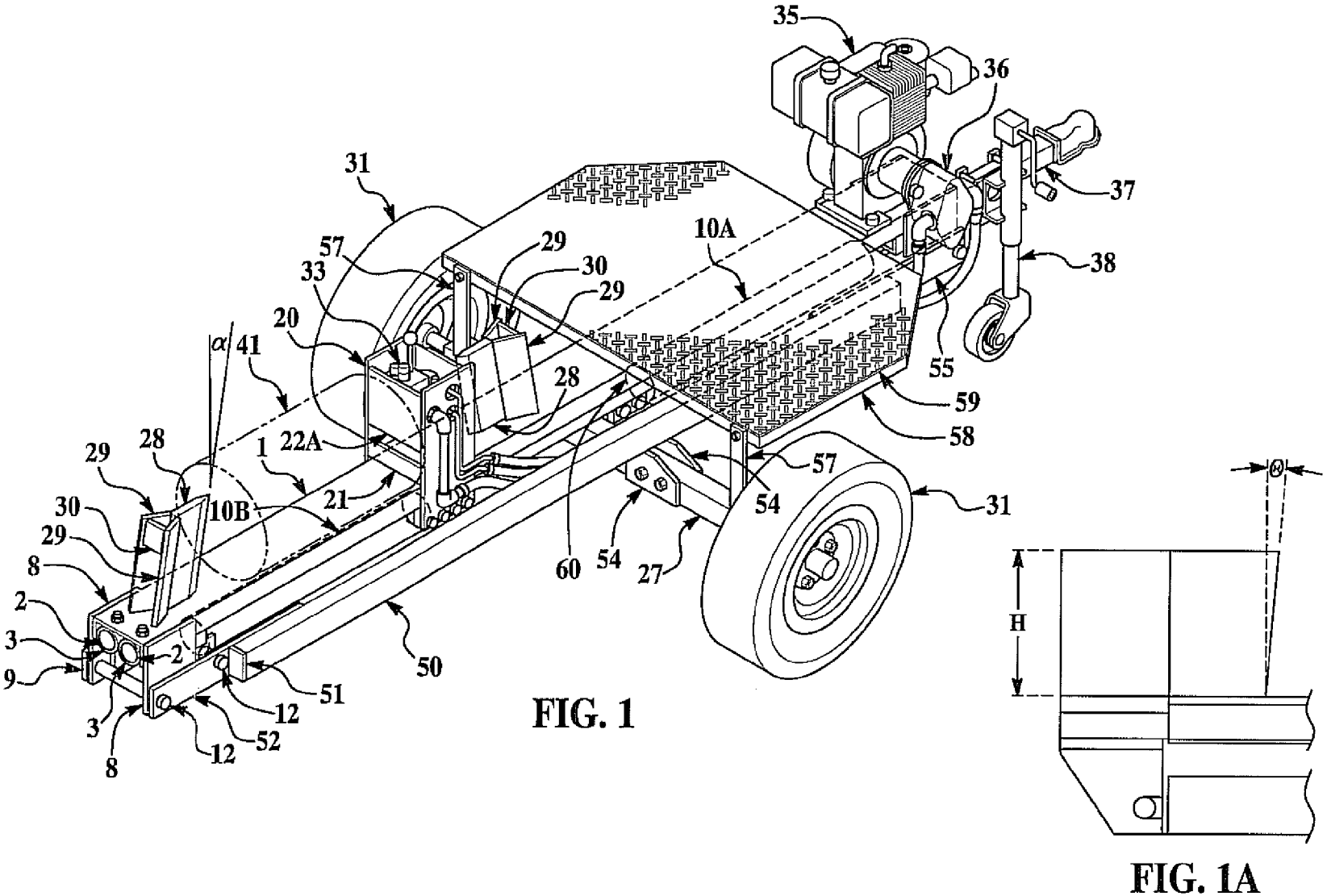
FIG. 1 is a perspective top view of the log-splitting device made in accordance with the present invention, illustrating the placement of a phantom log in the first position.
FIG. 1A is a side view of a splitting wedge in accordance with the invention.

Looking first to FIG. 1, there is shown a bi-directional log splitter made in accordance with the present invention, which includes the log-splitting device mounted on an axle and wheels and being hydraulically activated to split logs in either direction.

Main beam 1 acts as a support for the logs and is resting on top of guide rods 2, which are held in place by guide rod anchors 3. Guide rods 2 are straddled by strut plates 8, which are used for securing a pair of strut arms 9. In between the pair of strut arms 9 is located the first and second hydraulic cylinders 10A and 10B. Strut arms 9 are held in place by strut arm locator pins 12 to yield a rigid substructure for the entire log-splitting device. Looking now to the hydraulic ram which is generally denoted by the numeral 20, the ram includes a skid plate 21 and a valve locator plate 22A against which log 41 is placed in order to come into contact with splitting wedge 28. Attached to splitting wedge 28 are splitting wedge gussets 29 which are held in place and separated at the optimum distance by gusset spacer 30, which prevents collapsing of the gussets. The entire assembly of the log-splitting device is placed upon an axle 27 and held thereon by axle anchors and held in place by axle braces. The axles are attached to a wheel on either side 31, such that the log-splitting device is now trailerable.

Still referring to FIG. 1, there is also shown a hydraulic tank support for holding the pair of hydraulic reservoir tubes 50 having lines attached back up to the two-way valve 33 which is located within hydraulic ram 20. Gasoline engine 35 is located at the opposite end of the log-splitting device along main beam 1, and it includes a hydraulic pump 36 for operation. The trailer tongue 37 and trailer tongue support 38 are necessary during the trailering operation. A hydraulic fuel filter is utilized underneath the hydraulic reservoir 34 in order to clean the hydraulic fluid prior to it flowing through the lines.

Figure 2:
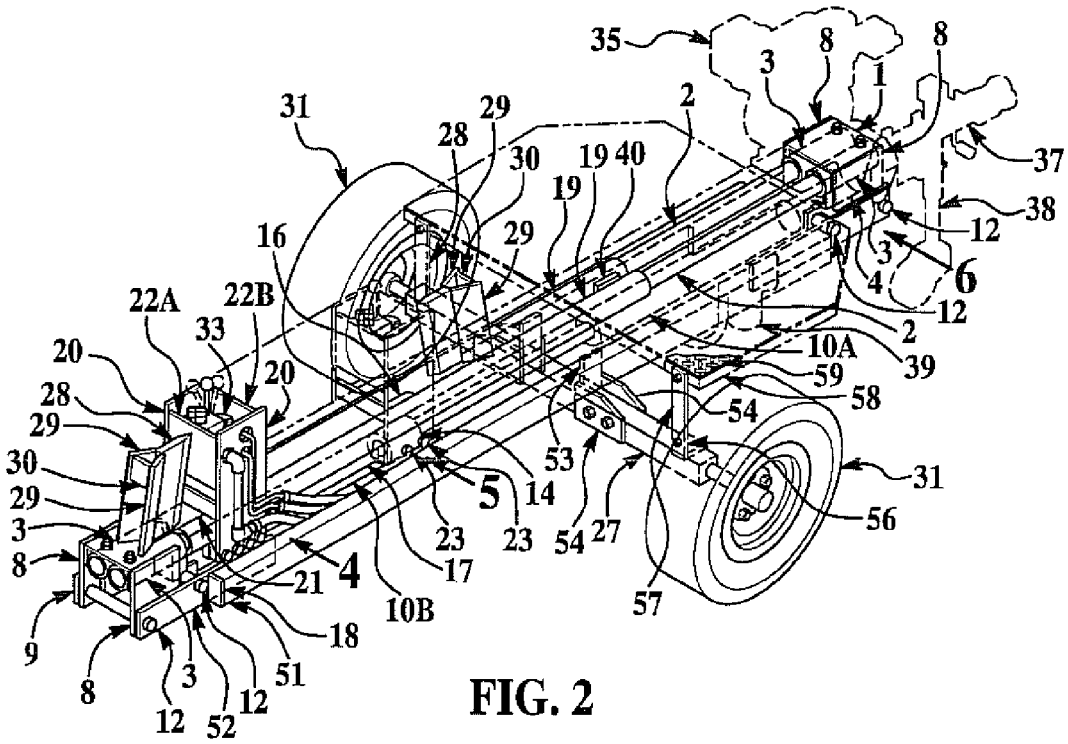
FIG. 2 is a perspective top view of a log-splitting device showing a hydraulic ram moving between the various positions of the two splitting wedges.
Figure 3:
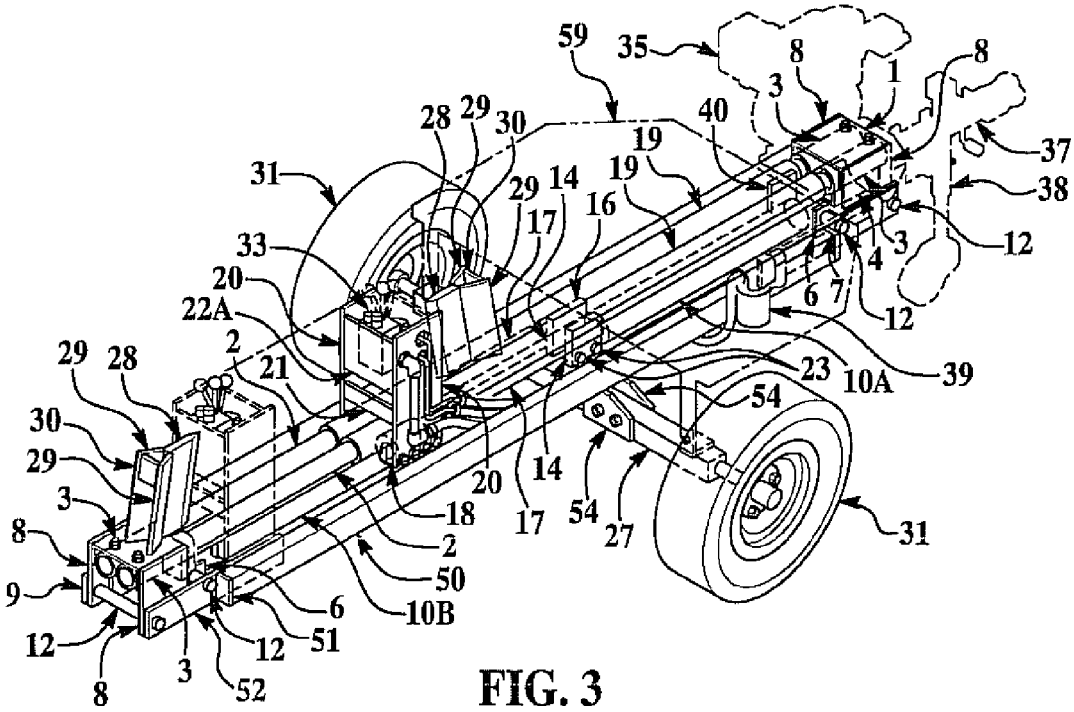
FIG. 3 is also a perspective top view of the log-splitting device showing the hydraulic ram in the return position.

With combined reference to FIGS. 2 and 3, there is generally shown the log-splitting device of the present invention with the hydraulic ram in the first and second positions, showing how the two-way log splitter is utilized. As can be seen in both Figures, there are two splitting wedges 28, including a front splitting wedge and a rear splitting wedge. Looking to FIG. 2, the hydraulic ram 20 is shown abutting against the front splitting wedge 28. This leaves a cavity along the main beam 1 to receive a log which will be compressed against the rear splitting wedge 28. In phantom is shown the hydraulic ram as it is moved towards the rear splitting wedge. Now looking to FIG. 3, once the hydraulic ram 20 is in position against the rear splitting wedge, a log may be placed on top of main beam 1 and, as shown in phantom, the hydraulic ram is then moved forward along the guide rods by first and second hydraulic cylinders 10A and 10B to compress a log (not shown) against the front splitting wedge 28. The splitting wedges shown in FIGS. 1 through 3 may preferably include an angled rake $\alpha$ (FIG. 1A) of from about 5° to about 25°, and may also include a four-way star-shaped wedge, adjustable up and down and capable of splitting a log into four pieces simultaneously. As shown in FIG. 1A, the splitting wedge 28 has a height of about 12 inches tall. At its maximum distance, hydraulic ram 20 has a gate opening distance between the opposite splitting wedge of from about 20 inches to about 60 inches. As the guide rods 2 are very secure, and prevent leverage effects during compression, this elongated gate opening is now possible.

Referring again to FIGS. 2 and 3, hydraulic ram 20 in FIG. 2 shows the position of the ram toward the front of the log-splitting device, where the front gate is shown in the closed position while the rear gate is open. In FIG. 3, the reverse of that situation is shown in which the front gate is now open while the rear gate is closed. In both FIGS. 2 and 3 the ram is shown in phantom in the final stage after the log has been split. Note that the guide tubes 19 have the hydraulic ram 20 riding thereon as will be more fully disclosed in FIG. 4 hereinbelow. However, it is illustrative in these two figures to note that the guide tubes 19 are telescopically sheathed over guide rods 2, thereby adding stability. In the present invention, the guide rods may be from about 65 inches to about 120 inches long, and preferably are in the range of 80 to 85 inches, thereby giving great stability and minimizing the leverage effect when compressing logs to be split.

Figure 4:
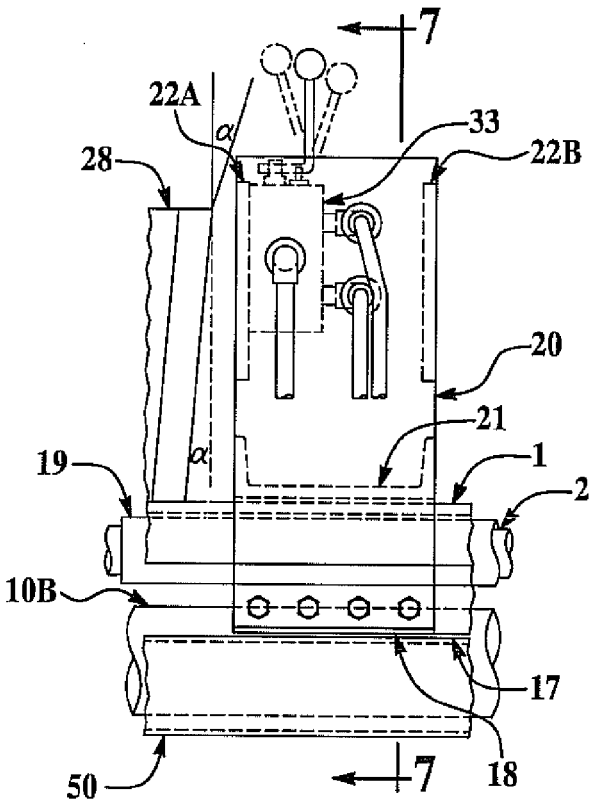
FIG. 4 is a side elevation view illustrating the relative placement of the splitting wedge and the hydraulic ram, as well as the hydraulic control arm.

Looking next to FIG. 4, there is shown a side elevational view taken along lines 4—4 of FIG. 2 showing the side elevational view of the hydraulic ram 20 with relative placement of the skid pad 21 on the inside of the ram mechanism 20. The hydraulic lines are shown cut off for clarity of the lower components. Hydraulic reservoir tube 50 is also shown in a cutaway version. Valve locator plate 22A is shown on the front of the ram, while a support plate 22B is shown in the rear. As can be seen with combined reference to FIGS. 4 and 7, the skid plate 21 acts to push the log towards splitting wedge 28. In the preferred embodiment of the present invention, the splitting wedge is approximately 12 inches tall, however, it may be of any suitable height, depending on the size of logs being split. And, again, the wedge rake angle is shown in FIG. 4 as being from approximately 5 to 25 degrees, and more preferably from about 10 degrees to about 15 degrees. As also discussed before, the splitting wedge may be a four-way star-shaped splitting wedge, so as to minimize the number of strokes required to split the logs into a maximum number pieces. The four-way star-shaped head, described hereinbelow more fully with reference to FIG. 12 and FIG. 13 will automatically split the log into four separate pieces.

Looking back to FIG. 4, the main beam 1 is the sliding mechanism and base for skid plate 21, while the guide rod 2 is telescopically enveloped within guide tube 19. Underneath guide tube 19 is the second hydraulic cylinder 10B. A guide tube brace 17 is attached to the underside of guide tube 19, which allows a slideable relationship between the hydraulic ram 20 and guide rod 2. As can be seen in more fully in FIG. 7, ram fastener plate 18 is held by a bolt to guide tube brace 17, to which hydraulic ram 20 is fastened. In other figures the hydraulic cylinder is shown as being connected.

Figure 5:
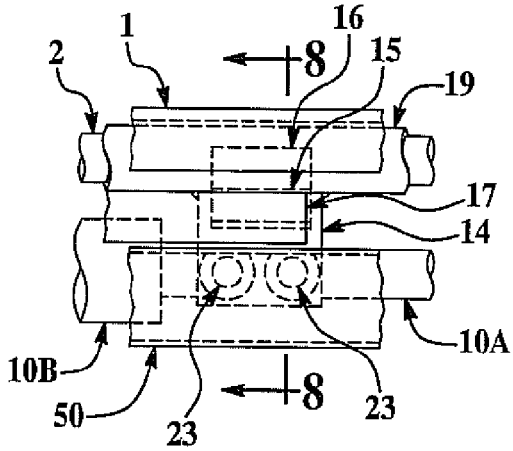
FIG. 5 is a side elevational view showing the relative placement of the two double-acting cylinders.

Looking now to FIG. 5, taken along lines 5—5 of FIG. 2, there is shown a side elevational view of the configuration of the first and second hydraulic cylinders 10A and 10B, respectively, their relative placement, and how they interrelate with the guide tube 19 and guide rod 2. Looking back to FIG. 2, there is shown a cylinder rod anchor 14 attached to guide tube brace 17 which is then connected to the main rod end anchor 16, at the rod ends of the cylinder by a pair of cylinder rod pins. Spacing blocks 15 keep the proper distance between cylinder rod anchors 14 and main rod end anchor 16.

Figure 6:
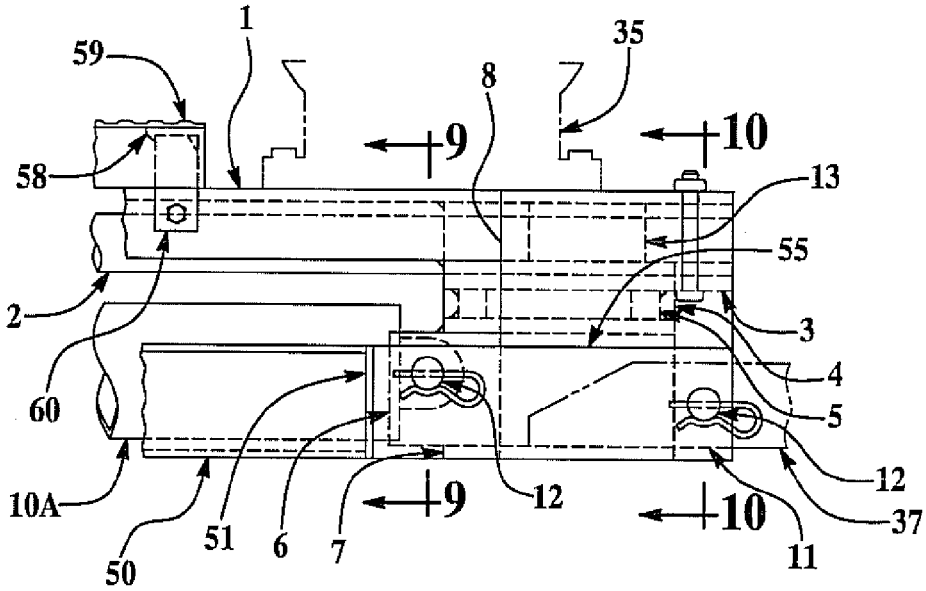
FIG. 6 is a side elevation cutaway view of the relative placement of the two double-acting cylinders.

Referring next to FIG. 6, taken along lines 6—6 in FIG. 2, at the rear of the log-splitting device, illustrates the placement of strut arm locator pins 12 for securing reservoir tube 50 to the frame 55. Guide rod anchors 3 are connected to the cylinder anchor plate 4 and is held apart by spacer block 5. Cylinder housing anchor 6 holds the first hydraulic cylinder 10A in place underneath main beam 1. Main beam 1 is an upside down U-shaped channel, which keeps all the components relatively clean during the log-splitting procedure. Main beam 1 covers and protects the guide rods 2 and the hydraulic cylinder 10A, and supports the logs as they are being split. Needless to say, wood chips are produced during the log-splitting procedure, and the wood chips fall down around over the main beam and past the cylinder, through the openings which are essentially made between the cylinder housing anchors 6 and reservoir tubs 50 onto the ground. Gasoline engine 35 is shown in phantom in its relative placement. Strut plates 8 hold the reservoir tubes 50 to frame 55, which run the entire length of both sides of the log-splitting device. Although the bracket is made of multiple pieces in the preferred embodiment of the invention, it can be easily envisioned by one of ordinary skill in the art to use fewer pieces, although they may not be so simple for maintenance and for removal of various components.

Figure 7:
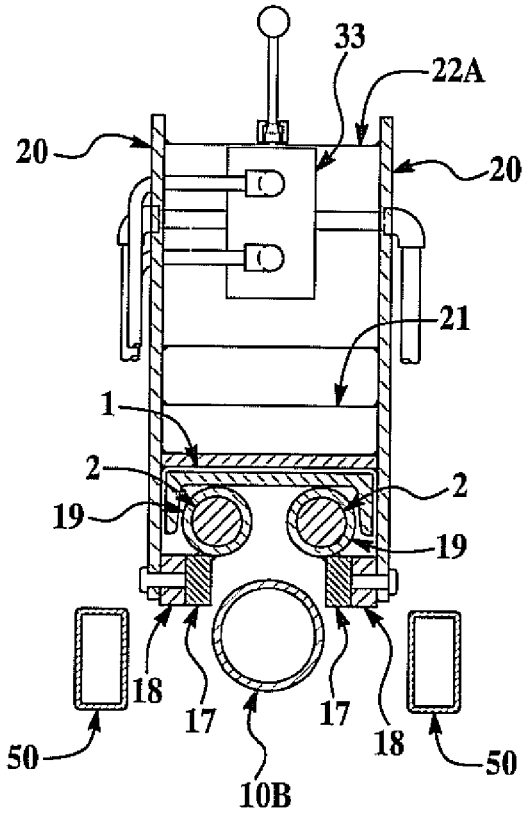
FIG. 7 is a front elevational view of the hydraulic ram, showing the relative placement of the hydraulic controls and hydraulic lines.

Looking now to FIG. 7, there is shown a front cut-away view of the hydraulic ram mechanism taken along lines 7—7 of FIG. 4. Again, for clarity of the diagram, the hydraulic lines are shown cut off, although in reality they continue and are attached to the hydraulic unit at the rear of the device. A two-way valve 33 is controlled on top by a hand lever (not numbered). The hand lever determines which direction the ram is going to be traveling, whether it will be closing the front gate or whether it is compressing a log and thereby closing the rear gate. Hydraulic ram 20 is shown in a cutaway view, and illustrates the relative placement of the valve locator plate 22A. The skid plate 21 is shown and would be the moving force for the log. The hydraulic ram 20 has a lower plate which rides on main beam 1 and is placed on top of the guide rods 2.

Figure 8:
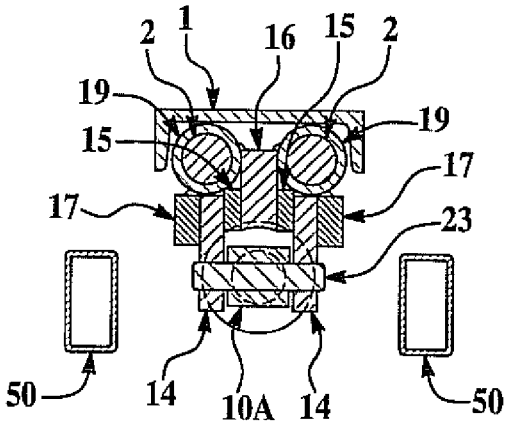
FIG. 8 is a front elevational view of the relative placement of the guide rods and the hydraulic cylinders.

FIG. 8 is a front cut-away view taken along lines 8—8 of FIG. 5, showing the front of the cylinder rod anchor. Rod end pin 23 passes through cylinder rod anchor 14 and the end of the first hydraulic cylinder.

Figure 9:
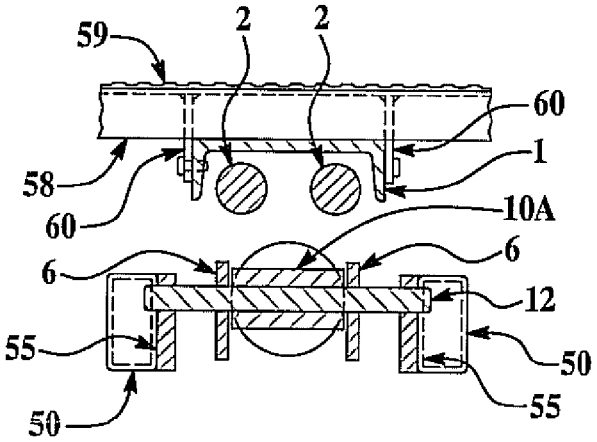
FIG. 9 is a front elevation view of the main beam and the strut arms.

Looking now to FIG. 9, and as described hereinabove with reference to FIG. 6, main beam 1 is shown shielding the guide rods 2, which is located above the first hydraulic cylinder 10A. Cylinder housing anchor 6 holds the end of first hydraulic cylinder 10A and is held in place by strut arm locator pins 12 which extend through strut arms 9. As described above, the wood chips can fall down over main beam 1, and can fall between the cylinder housing anchor 6 and strut arms 9.

Figure 10:
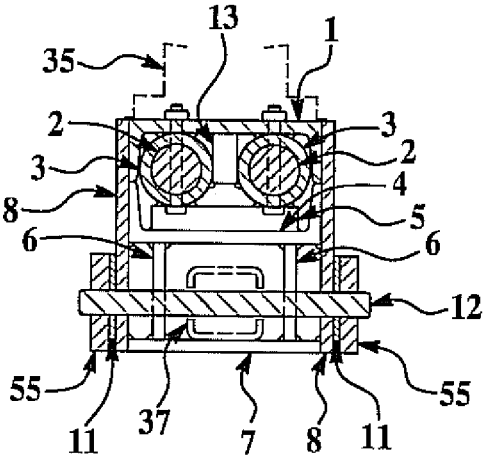
FIG. 10 is also a front elevation view taken along lines 10—10 of FIG. 6, illustrating the relative placement of the components to reduce the lever arm effect.

Next, we look to FIG. 10, which is taken along lines 10—10 of FIG. 6, in which the end of the guide rods 2 are shown secured to the main beam 1 and guide rod anchors 3 hold fast to the cylinder anchor plate 4, kept in place by spacer block 5. What can also be seen from the rear of the log-splitting device is that strut arms 9 are held apart from the strut plates 8 via strut arm spacer plates 11. Strut arm locator pins 12 secure the entire device to the trailer tongue 37. The guide rods 2 are held in place horizontally by guide rod anchor spacer 43 and spacer block 5. Strut plates 8 flank either side of the guide rod 2 assembly, and are from about 5 to about 15 inches tall, preferably from about 8 to about 9 inches tall, so that the leverage effect is not as great when the channel compresses a log resting on the working surface of main beam 1. If the height of the strut plates 8 were much greater than that figure, leverage arm effects would be more evident, and the present design minimizes that leverage effect. As one can imagine, as a log is compressed, certain forces act to buckle and leverage when the channel compresses the working distance.

Figure 11:
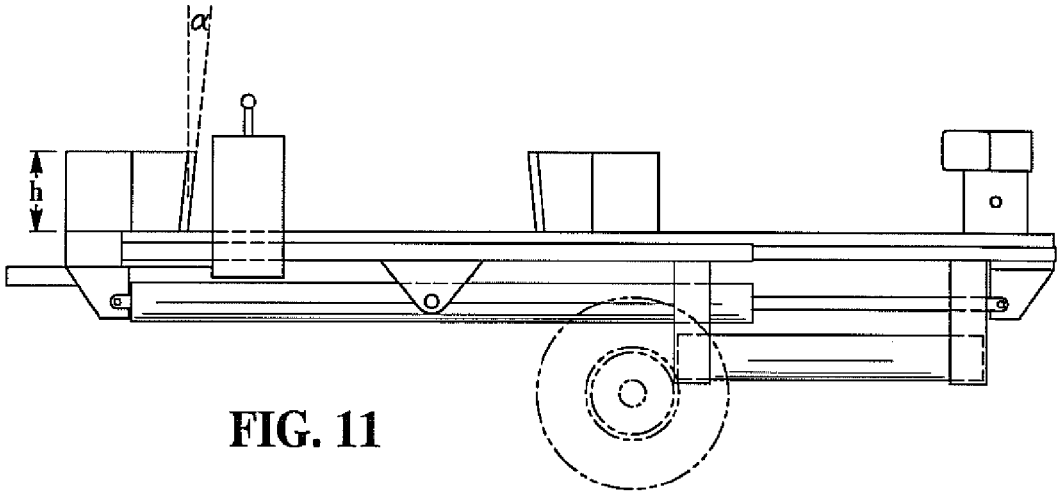
FIG. 11 is a side elevational view of another embodiment of the present invention.

Looking next to FIG. 11, there is shown a different configuration for the dual cylinder set up, and is yet another embodiment of the present invention. A double set of cylinders is engaged in an in-line configuration, for pushing and pulling the push ram as shown in FIG. 11. The embodiment of this figure also utilizes the main structural channel beam located over the guide rods, yields a two-way log splitter with dual hydraulic cylinders, in opposed positions. Again, as can be seen from FIG. 11, there are two splitting wedges, a front splitting wedge and a rear splitting wedge, each having an advanced rake on the order of about ten degrees, with a push ram thereinbetween. When the push ram is in the forward position, the front gate is considered "closed", and the rear gate is considered "open". Although any suitable opening is envisioned by the inventor, the gate opening is shown having a distance of about 30 inches between the push ram and the splitting wedge, in order to receive a log to be split. The hydraulic control valve is pushed into the backward position, which pushes the ram against the log (not shown) against the rear splitting wedge. As the log splits, it falls onto either side of the log splitter, and the push ram can then be placed adjacent to the rear splitting wedge in operation. Therefore, the front gate will have a gate opening of about 30 inches and a log can be placed between the front splitting wedge and the push ram. The operator will then push the hydraulic control valve to the forward position, and compress the log against the front splitting wedge, thereby splitting the log. This operation is repeated over and over again until the log splitting operation is finished.

Figure 12:
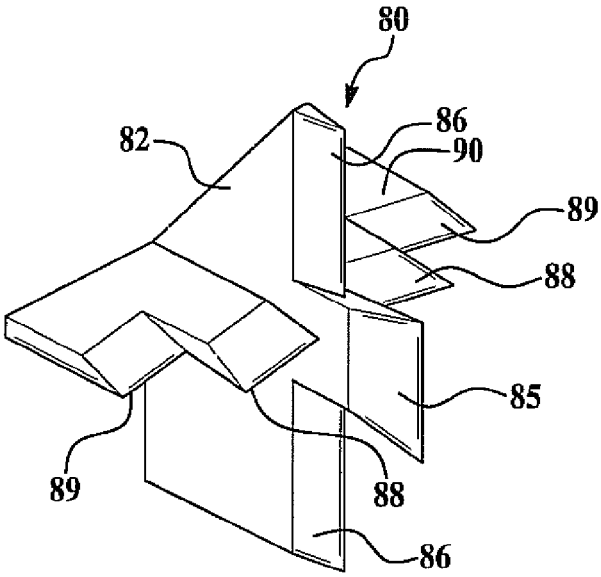
FIG. 12 is a perspective view of a star-shaped wedge made in accordance with the present invention.
Figure 13:
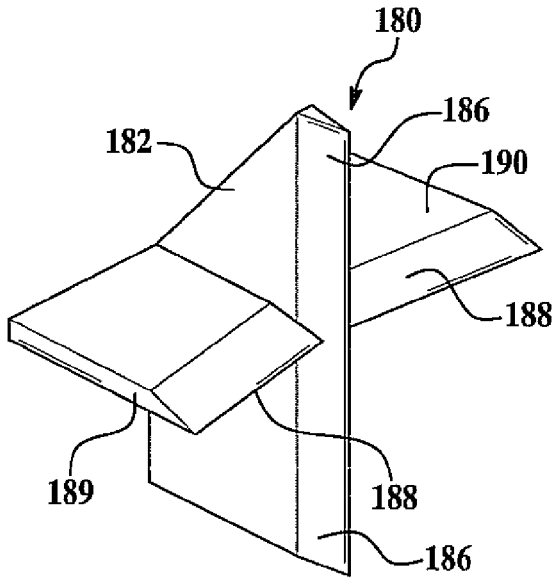
FIG. 13 is yet another wedge embodiment.

Looking next to FIG. 12, there is shown a four-way star-shaped splitting wedge which may be utilized with the present invention, in the place of the front and rear splitting wedges shown in FIGS. 1 through 10. Although the present inventor does not claim inventing the star-shaped splitting wedge, it is envisioned that this star-shaped wedge is useful in the present invention. The star-shaped splitting wedge is generally denoted by the numeral 80, and includes a wedge spacer 82 having wedge face plates or splitting wedges 86 extending forward therefrom. The forward most splitting wedge 85 is attached to the front of spacer wedge 82, and may extend forward as shown in FIG. 12, or may be an extension of the splitting wedges 86, as shown more fully hereinbelow with regard to FIG. 13. The horizontal splitting surfaces 88 and 89, respectively, may be utilized for splitting the wood in a horizontal direction in addition to the vertical direction which would be cut by splitting wedges 86.

FIG. 13 again illustrates the star-shaped splitting wedge generally denoted by numeral 180 including a spacer wedge 182 having a front splitting wedge 186 and also having attached thereto, horizontal components 189 and 190, respectively, which include a front splitting wedge surface angle 188.

Therefore, the present invention has been described and discussed in enough detail such that one of ordinary skill in the art could reproduce it without undue experimentation. The present invention meets or exceeds all of the above-described objects and advantages and may be utilized to best advantage when considering the ranges of angles, distances and configurations described hereinabove.

The foregoing description of a preferred embodiment of the invention has been presented for purposes of illustration and description. It is not intended to be exhaustive or to limit the invention to the precise form disclosed. Obvious modifications or variations are possible in light of the above teachings with regards to the specific embodiments. The embodiment was chosen and described in order to best illustrate the principles of the invention and its practical applications to thereby enable one of ordinary skill in the art to best utilize the invention in various embodiments and with various modifications as are suited to the particular use contemplated. It is intended that the scope of the invention be defined by the claims which are appended hereto.

What is claimed is:

1. A bi-directional log splitter, comprising:

a trailerable wheeled frame having a main beam along its longitudinal axis with an upper surface for supporting a log thereon;

a pair of bi-directional equal force hydraulic log splitting cylinders horizontally oriented on said frame, wherein the extension force is substantially equal to the retraction force of each of the cylinders;

at least two stationary splitting wedges permanently secured to the upper surface of the wheeled frame, said splitting wedges having the wedges facing toward each other and being oriented horizontally for applying pressure to logs that are urged thereagainst and being arranged to split logs;

a bi-directional horizontally moveable hydraulic ram attached to the pair of hydraulic cylinders for movement in both directions between the at least two splitting wedges, and depending on which direction the cylinders are directed, said ram advances the logs toward each of and between the splitting wedges by the extension and retraction of the attached hydraulic cylinders in order to effect log splitting in both directions; and a guide structure having a pair of guide rods directing the pair of hydraulic cylinders to operate in a proper orientation.

2. The splitter of claim 1, further comprising a trailer hitch for releasably connecting and attaching to a towing vehicle.

3. The splitter of claim 1, wherein the at least two splitting wedges include splitting wedges having raked angles of between about 5° and about 25° to more efficiently split the wood.

4. The splitter of claim 1, wherein each of the at least two splitting wedges is about 12 inches tall.

5. The splitter of claim 1, further comprising a skid plate for supporting the logs thereon.

6. A bi-directional log splitter, comprising:

a trailerable wheeled frame having a main beam along its longitudinal axis with an upper surface for supporting a log thereon;

a pair of bi-directional equal force hydraulic log splitting cylinders horizontally oriented on said frame, wherein the extension force is substantially equal to the retraction force of each of the cylinders;

at least two stationary splitting wedges permanently secured to the upper surface of the wheeled frame, said splitting wedges having the wedges facing toward each other and being oriented horizontally for applying pressure to logs that are urged thereagainst and being arranged to split logs;

a bi-directional horizontally moveable hydraulic ram attached to the pair of hydraulic cylinders for movement in both directions between the at least two splitting wedges, and depending on which direction the cylinders are directed, said ram advances the logs toward each of and between the splitting wedges by the extension and retraction of the attached hydraulic cylinders in order to effect log splitting in both directions; and at least a pair of guide rods for directing the pair of hydraulic cylinders.

7. The splitter of claim 6, further comprising a trailer hitch for releasably connecting and attaching to a towing vehicle.

8. The splitter of claim 6, wherein the at least two splitting wedges include splitting wedges having raked angles of between about 5° and about 25° to more efficiently split the wood.

9. The splitter of claim 6, wherein each of the at least two splitting wedges is about 12 inches tall.

10. The splitter of claim 6, further comprising at least a pair of guide tubes for providing support to the pair of hydraulic cylinders and strengthening the hydraulic action during the operation of log splitting.

11. The splitter of claim 6, further comprising a skid plate for supporting the logs thereon.

12. A bi-directional log splitter, comprising:

a trailerable wheeled frame having a main beam along its longitudinal axis with an upper surface for supporting a log thereon;

a pair of bi-directional equal force hydraulic log splitting cylinders horizontally oriented on said frame, wherein the extension force is substantially equal to the retraction force of each of the cylinders;

at least two stationary splitting wedges permanently secured to the upper surface of the wheeled frame, said splitting wedges having the wedges facing toward each other and being oriented horizontally for applying pressure to logs that are urged thereagainst and being arranged to split logs;

a bi-directional horizontally moveable hydraulic ram attached to the pair of hydraulic cylinders for movement in both directions between the at least two splitting wedges, and depending on which direction the cylinders are directed, said ram advances the logs toward each of and between the splitting wedges by the extension and retraction of the attached hydraulic cylinders in order to effect log splitting in both directions; and at least a pair of guide tubes providing support to the pair of hydraulic cylinders and strengthening the hydraulic action during the action of log splitting.

13. The splitter of claim 12, further comprising a trailer hitch for releasably connecting and attaching to a towing vehicle.

14. The splitter of claim 12, wherein the at least two splitting wedges include splitting wedges having raked angles of between about 5° and about 25° to more efficiently split the wood.

15. The splitter of claim 12, wherein each of the at least two splitting wedges is about 12 inches tall.

16. The splitter of claim 12, further comprising at least a pair of guide rods for directing the pair of hydraulic cylinders in the proper orientation.

17. The splitter of claim 12, further comprising a skid plate for supporting the logs thereon.

18. A bi-directional log splitter, comprising:

a trailerable wheeled frame having a main beam along its longitudinal axis with an upper surface for supporting a log thereon;

a pair of bi-directional equal force hydraulic log splitting cylinders horizontally oriented on said frame, wherein the extension force is substantially equal to the retraction force of each of the cylinders;

at least two stationary splitting wedges permanently secured to the upper surface of the wheeled frame, said splitting wedges having the wedges facing toward each other and being oriented horizontally for applying pressure to logs that are urged thereagainst and being arranged to split logs;

a bi-directional horizontally moveable hydraulic ram attached to the pair of hydraulic cylinders for movement in both directions between the at least two splitting wedges, and depending on which direction the cylinders are directed, said ram advances the logs toward each of and between the splitting wedges by the extension and retraction of the attached hydraulic cylinders in order to effect log splitting in both directions; and a guide structure having a pair of guide tubes for providing support to the pair of hydraulic cylinders and strengthening the hydraulic action during the operation of log splitting.

* * * * *